US006616580B1

(12) United States Patent
Chen

(10) Patent No.: US 6,616,580 B1
(45) Date of Patent: Sep. 9, 2003

(54) COLLAPSIBLE COMBINATION WAIST AND LEG EXERCISER

(76) Inventor: Ko-Chuan Chen, P.O. Box 55-175, Taichung (TW)

( * ) Notice: Subject to any disclaimer, the term of this patent is extended or adjusted under 35 U.S.C. 154(b) by 0 days.

(21) Appl. No.: 09/651,241

(22) Filed: Aug. 30, 2000

(51) Int. Cl.[7] ..... A63B 21/045
(52) U.S. Cl. ..... 482/123; 482/127; 482/130
(58) Field of Search ..... 482/90–92, 121–123, 482/127, 129, 130

(56) References Cited

U.S. PATENT DOCUMENTS 1,324,404 A * 12/1919 Metzger ..... 482/127
2,184,453 A * 12/1939 Hayes ..... 482/90
2,186,403 A * 1/1940 Bullis et al. ..... 482/90
3,022,072 A * 2/1962 Zinnow ..... 482/90
4,603,853 A * 8/1986 Satterthwaite ..... 482/35
4,625,963 A * 12/1986 Lancellotti ..... 482/130
5,752,901 A * 5/1998 Lee ..... 482/130
5,772,563 A * 6/1998 Lin ..... 482/121
6,090,023 A * 7/2000 Liu ..... 482/130
6,220,995 B1 * 4/2001 Chen ..... 482/121
6,375,601 B1 * 4/2002 Johnson ..... 482/139
6,402,669 B1 * 6/2002 Olstad ..... 482/123

* cited by examiner

*Primary Examiner*—Jerome W. Donnelly
*Assistant Examiner*—Victor Huang

(57) ABSTRACT

A collapsible combination waist and leg exerciser comprises a base, two elastic frames, and two connected handles. In use, user may stand on base with hands grasped on the handles and bend waist forward facing elastic frames in order to exercise up and down repeatedly. User may also sit on a chair with the chair's legs pressed on base by the weight of user. User's feet are urged against the top of handles for exercising up and down repeatedly. User may lay back with feet urged against the top of handles in a continuous up and down movement. This can train or develop the parts of body such as chest, arms, waist, legs, and buttock effectively in a small environment.

9 Claims, 7 Drawing Sheets

COLLAPSIBLE COMBINATION WAIST AND LEG EXERCISER

FIELD OF THE INVENTION

The present invention relates to exercise equipment and more particularly to a collapsible combination waist and leg exerciser with improved characteristics.

BACKGROUND OF THE INVENTION

The fitness craze, which captivated the attention of ever increasing numbers of people throughout the world, has spawned an endless array of exercise equipment. One of this array of exercise equipment is indoor exerciser. Indoor exercisers are popular because many people do not have time to go to a suitable field to exercise after work. A typical indoor exerciser aims at providing people a means to train or develop some part of the body. For example, there are jog exercisers, cycling exercisers, etc. In general they are beneficial to the parts of body such as chest, arms, waist, legs, and buttock respectively.

However, the previous design suffered from several disadvantages. For example, they are often too bulky to be readily provided in home. Further, they are single purpose exercisers, i.e., implemented only as abdominal exerciser, chest exerciser, etc.

Thus, it is desirable to provide a collapsible combination waist and leg exerciser in order to overcome the above drawbacks of prior art.

SUMMARY OF THE INVENTION

It is an object of the present invention to provide a collapsible combination waist and leg exerciser comprising a base, a pair of elastic frames, and a pair of handles. A number of preferred forms of exercises are implemented. For example, user may stand on base with hands grasped on the handles and bend waist forward facing elastic frames in order to exercise up and down repeatedly for training the muscles of chest, arms, and waist. User may also sit on a chair with the chair's legs pressed on base by the weight of user. User's feet are urged against the top of handles. In exercise, user presses feet and legs to force handles up and down repeatedly for exercising. This can train or develop the muscles of inner sides of legs and buttock. User may lay back with foot (or feet) urged against the top of handle(s) in a continuous up and down movement. This can train or develop the muscles of legs and buttock.

It is another object of the present invention to provide a collapsible combination waist and leg exerciser which is compact for being provided in home, simple with detachable components, and low cost.

The above and other objects, features and advantages of the present invention will become apparent from the following detailed description,taken with the accompanying drawings.

DETAILED DESCRIPTION OF THE PREFERRED EMBODIMENTS

Figure 1:
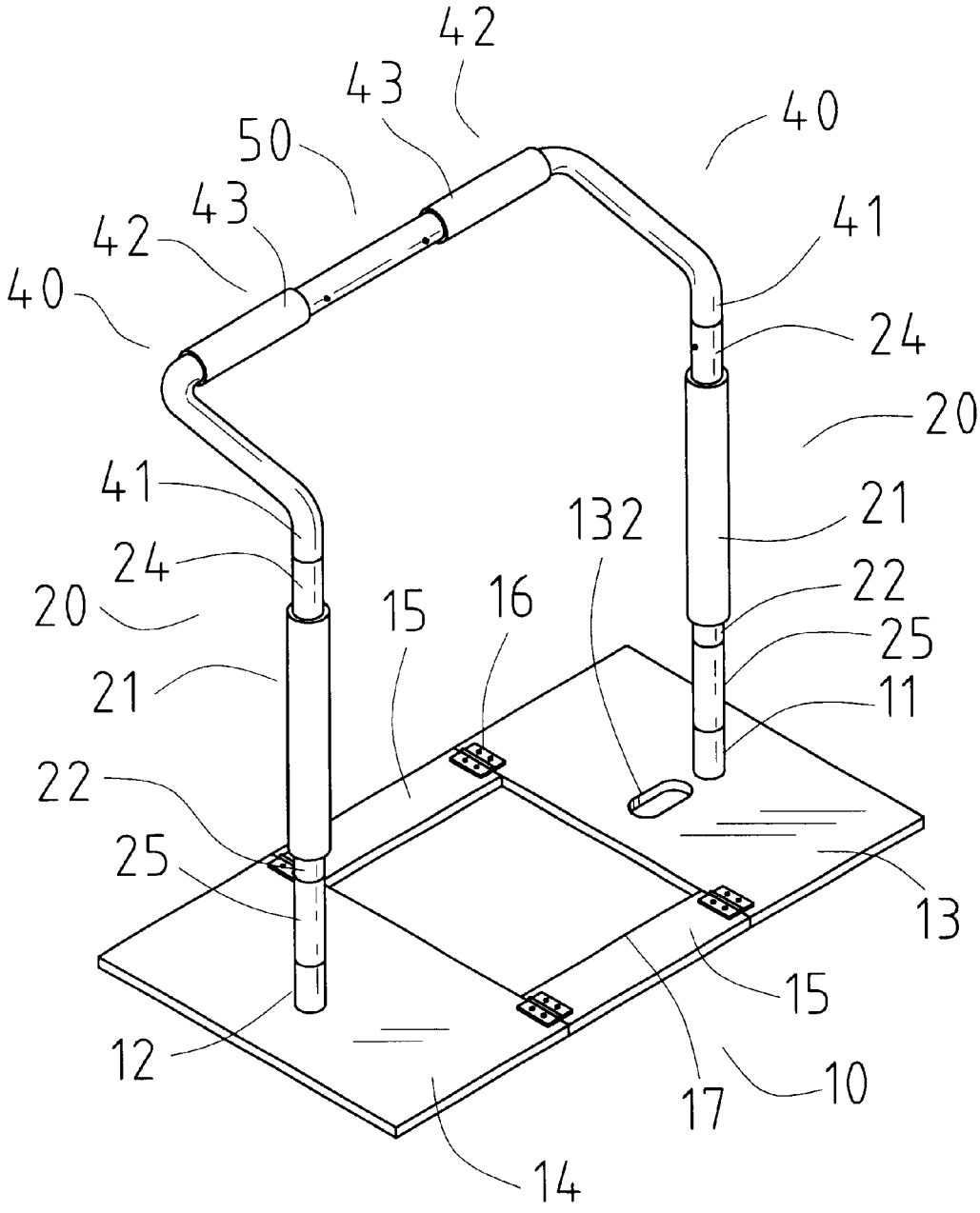
FIG. 1 is a perspective view of a first preferred embodiment of collapsible combination waist and leg exerciser according to the invention.
Figure 2:
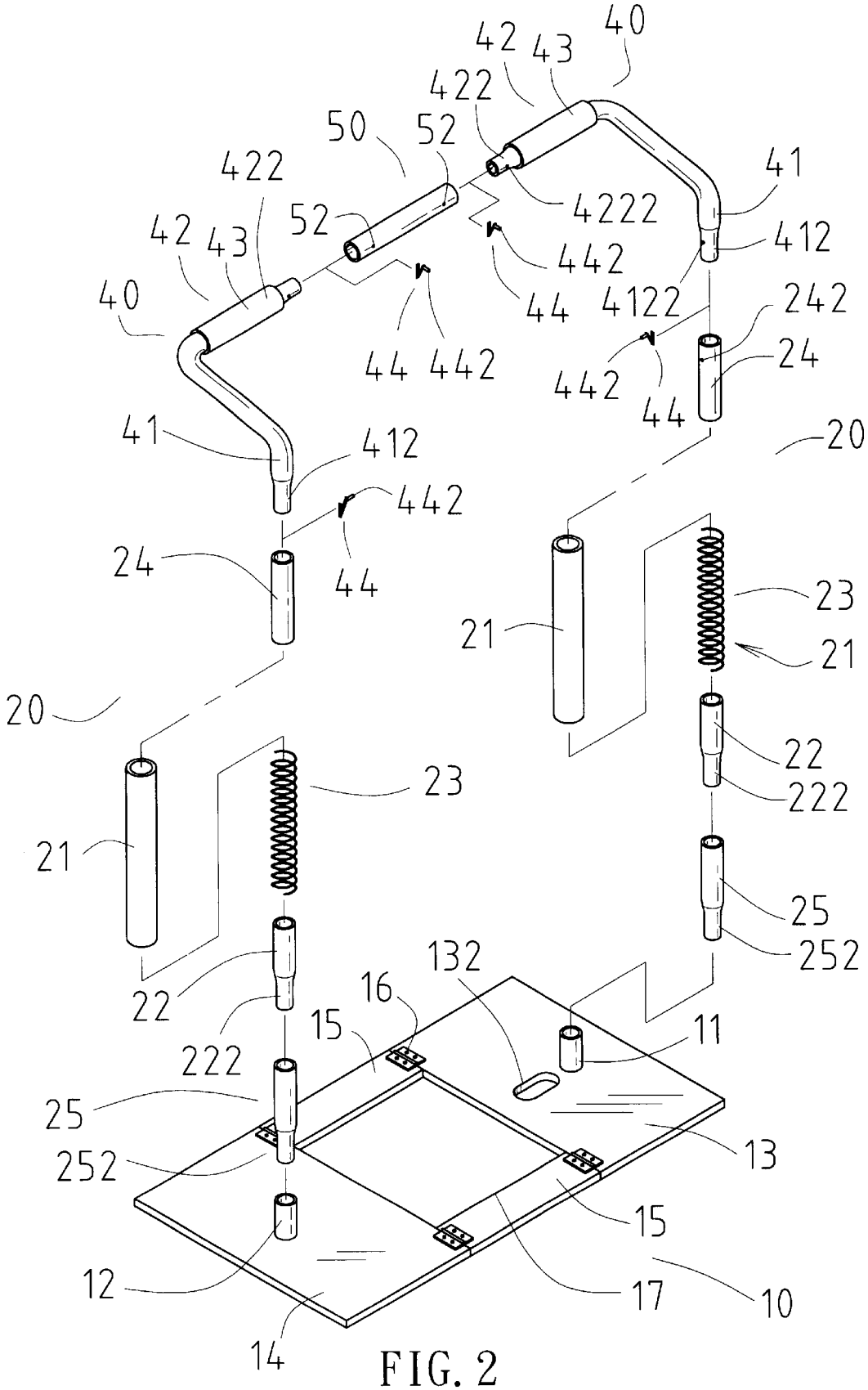
FIG. 2 is an exploded view of the FIG. 1 exerciser.

Referring to FIGS. 1–2, there is shown a collapsible combination waist and leg exerciser constructed in accordance with the invention comprising a base 10, a pair of elastic frames 20, and a pair of handles 40. Frames 20 and handles 40 are generally tube members. Base 10 has a pair of opposite protruded circular sockets 11, 12. Each elastic frame 20 comprises a lower sub-frame 22, an upper sub-frame 24, and elastic member 23 (e.g., coil spring) releasably connected between the sub-frames 22 and 24, a pad 21 made of a foam rubber enclosing the elastic member 23 and portions of sub-frames 22, 24 as exercise protection means, and a support sub-frame 25 having a reduction bottom end 252 for inserting into socket 11 or 12 for supporting frame 20. The bottom end 222 of lower sub-frame 22 is also reduced for inserting into support sub-frame 25. Handle 40 comprises a vertical portion 41 having a reduction end 412 for inserting into support sub-frame 24, a horizontal portion 42 extended toward the other horizontal portion 42, and a pad 43 made of a foam rubber enclosing a portion of horizontal portion 42. A short bar 50 is detachably connected between the reduction ends 422 of the horizontal portion 42. One locking device 44 is locked in aperture 4122 of vertical portion 41 and aperture 242 of sub-frame 24, while another locking device 44 is locked in aperture 4222 of horizontal portion 42 and aperture 52 of short bar 50 in an operating position. This forms the exerciser of the invention.

Figure 3:
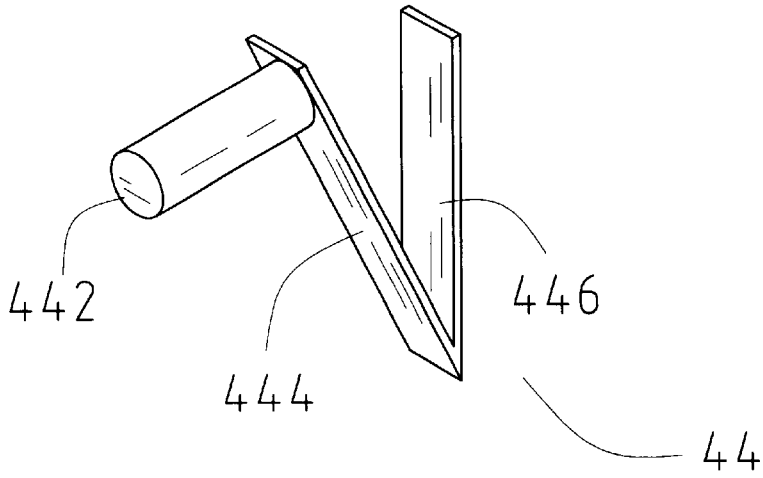
FIG. 3 is a perspective view of locking device shown in FIG. 1.
Figure 4:
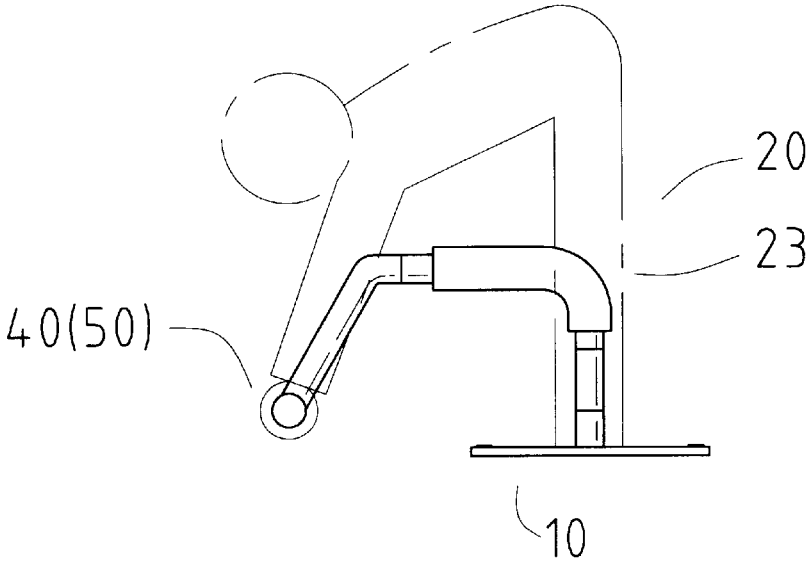
FIGS. 4 to 7 are environmental views illustrating preferred forms of exercising.

Referring to FIG. 3, locking device 44 is of resilient comprising a vertical member 446, an angled member 444, and a pin 442 which is biased outward by angled member 444 to insert in the apertures 4222, 52 or 4122, 242 in the operating position. For example, user may push pin 442 inward to clear from aperture 242 of sub-frame 24 in order to unlock vertical portion 41 and sub-frame 24.

FIGS. 4 to 7 illustrates preferred forms of exercise implemented by using the FIG. 1 apparatus. For example in FIG. 4, user (shown in phantom lines) may stand on base 10 with hands grasped on the handles 40 (or bar 50) and bend waist forward facing elastic frames 20 in order to exercise up and down repeatedly. As shown, elastic frames 20 are also extended and bent. With this, it is possible to train or develop the muscles of chest, arms, and waist.

Figure 5:
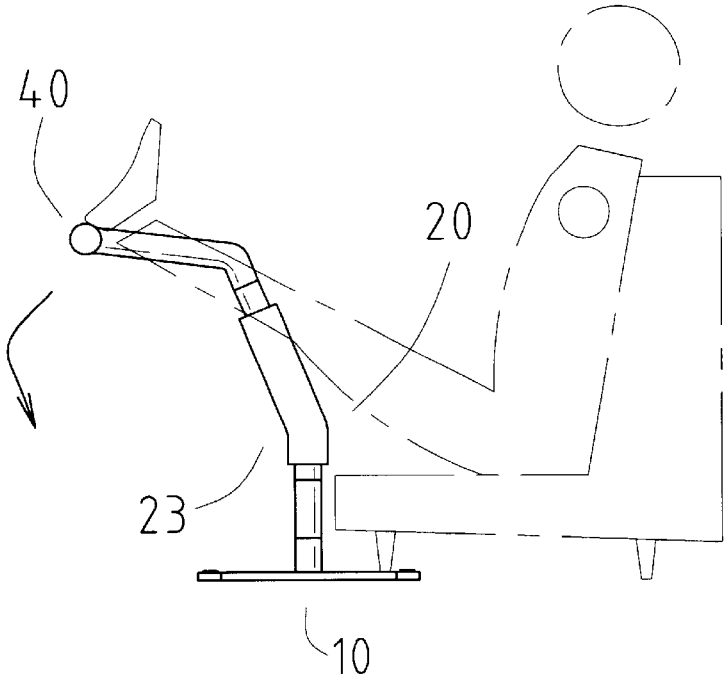
Figure 6:
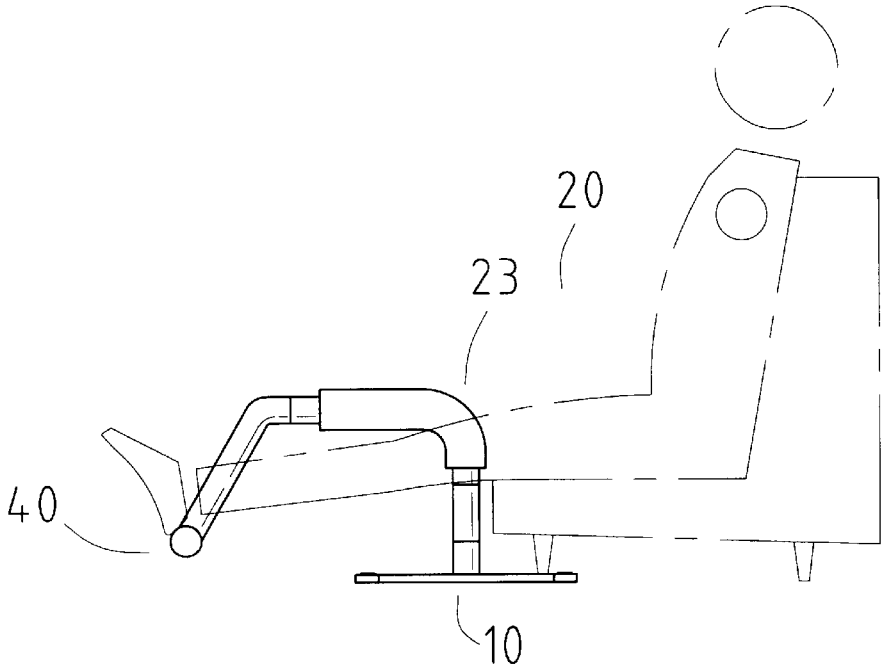

In FIGS. 5 and 6, user may sit on a chair with the chair's legs pressed on base 10 by the weight of user. As shown, feet are urged against the top of handles 40 (FIG. 5). In exercise, user presses feet and legs to force handles 40 down to a limit (FIG. 6). User can repeat this process for exercising. As shown, elastic frames 20 are extended and bent. With this, it is possible to train or develop the muscles of inner sides of legs and buttock.

Figure 7:
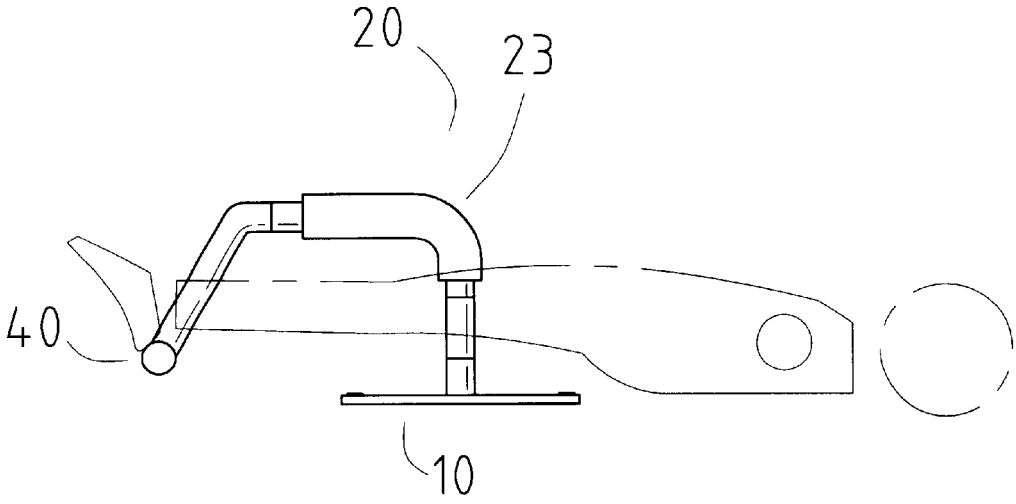

In FIG. 7, user may lay back with foot (or feet) urged against the top of handle(s) 40 in a continuous up and down movement. This can train or develop the muscles of legs and buttock.

Figure 8:
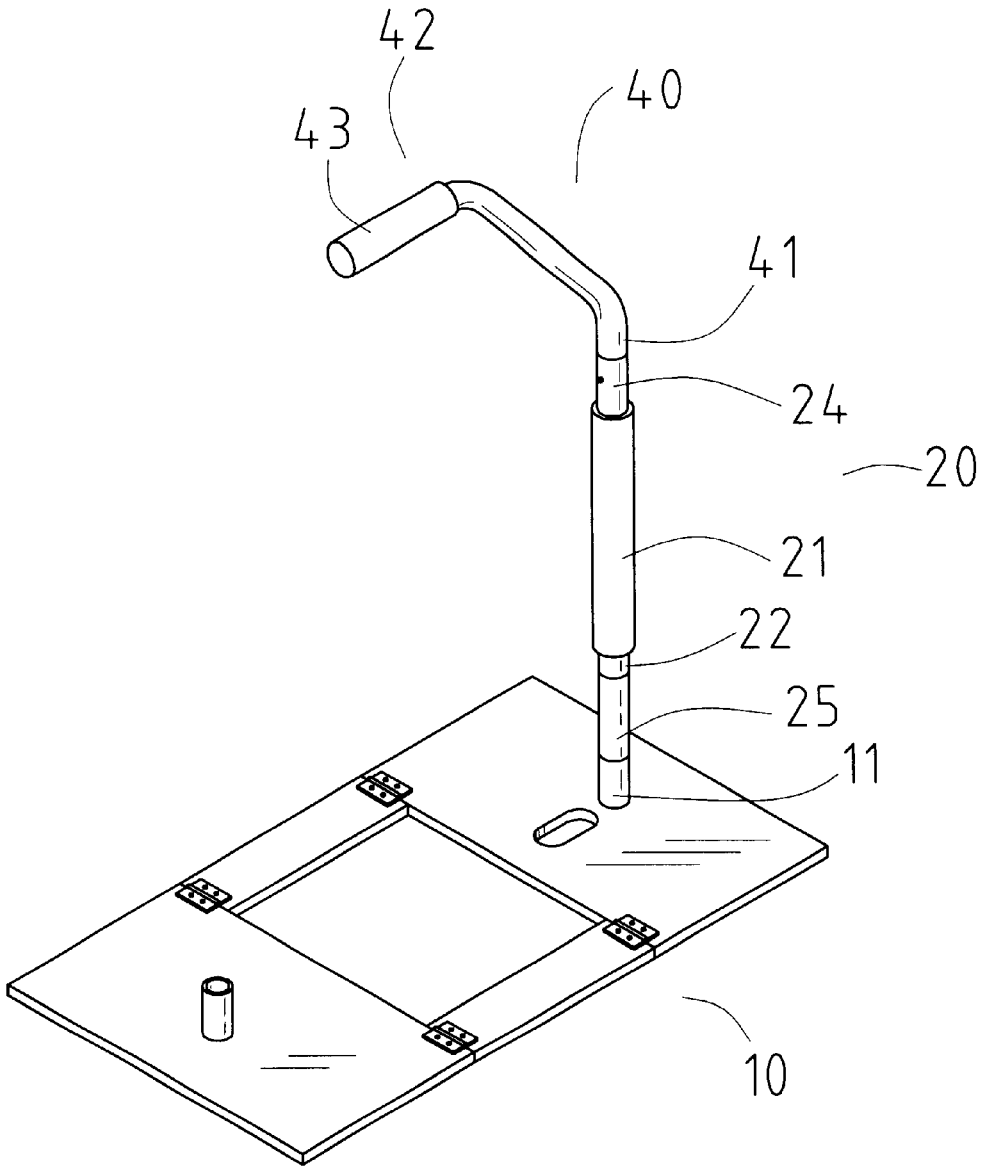
FIG. 8 is another perspective view of the FIG. 1 exerciser showing another preferred form of exercising.

It is contemplated by the present inventor that user, who is not physically strong enough such as a beginner, may use the apparatus shown in the embodiment of FIG. 8. A single handle 40 in conjunction with single elastic member 23 of elastic frame 20 can provide a smaller resistance to user when bent. As such, a potential strain and/or hurt to user are eliminated. It is recommended that as user's muscles strengthened, user may choose to use the apparatus shown in the embodiment of FIG. 1 in order to execute a vigorous workout.

It is understood that it is possible to install more than one support sub-frame 25 connected in series between sub-frame 22 and socket 11 for being readily adapted to the height of individual user. In other words, the apparatus is height adjustable.

Figure 9:
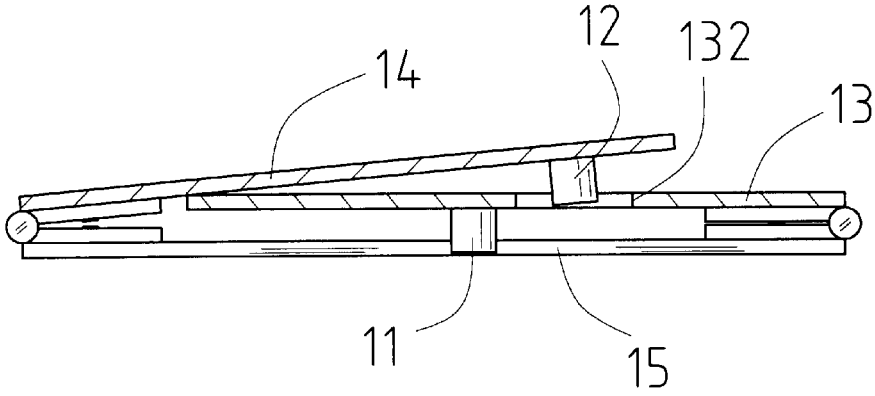
FIG. 9 is a cross-sectional view of a portion of the folded FIG. 1 exerciser.

Referring to FIG. 9 in conjunction with FIGS. 1 and 2 again, base 10 comprises a first plate 13, a second plate 14, two connecting plates 15 hinged between first plate 13 and second plate 14 by hinges 16, and a center opening 17. In storage, first remove frames 20, handles 40, and bar 50. Then fold first plate 13 and second plate 14 toward each other with socket 11 in center opening 17 and socket 12 in slot 132. This reduces much storage space.

Figure 10:
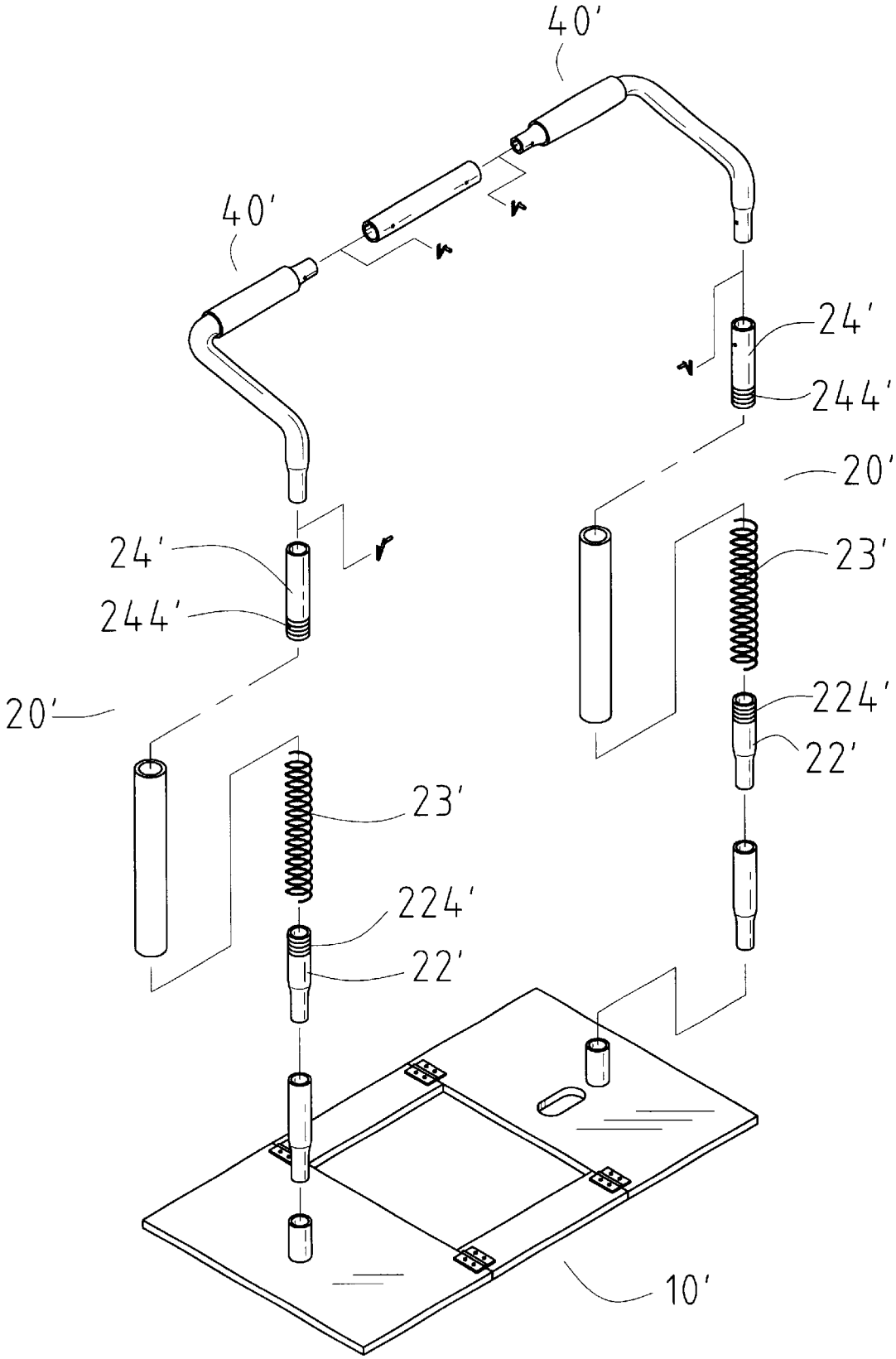
FIG. 10 is an exploded view of a second preferred embodiment of collapsible combination waist and leg exerciser according to the invention.

FIG. 10 illustrates a second preferred embodiment of the invention. The differences between second and first embodiments are detailed below. The bottom end of upper sub-frame 24' is formed as threaded portion 244' engaged with the upper portion of elastic member 23', while the top end of lower sub-frame 22' is formed as threaded portion 224' engaged with the lower portion of elastic member 23'. This may enhance the engagement between elastic member 23' and sub-frame 24' as well as between elastic member 23' and sub-frame 22'.

The operations of second embodiment is the same as that of first embodiment. Thus a detail description thereof is omitted herein for the sake of brevity.

While the invention herein disclosed has been described by means of specific embodiments, numerous modifications and variations could be made thereto by those skilled in the art without departing from the scope and spirit of the invention set forth in the claims.

What is claimed is:

1. A collapsible combination waist and leg exercise apparatus comprising:

a base having a first plate, a second plate, and two connecting plates hinged between the first and second plates;

said first plate and said second plate each having a socket mounted thereon;

each socket having an elastic frame selectively received therein;

each elastic frame comprising a lower sub-frame, an upper sub-frame, an elastic member connected between the lower and upper sub-frames, and a support sub-frame attached to the lower sub-frame for insertion into a respective said socket;

a pair of handles, each attached to a respective said upper sub-frame; and a bar selectively connecting said pair of handles, wherein said base is collapsible by folding said first and second plates relative to said connecting plates and a user exercises by engaging said handles or said bar to actuate at least one of said elastic frames.

2. The exercise apparatus of claim 1, wherein each said handle comprises a vertical portion and a horizontal portion.

3. The exercise apparatus of claim 2, wherein said vertical portion and said horizontal portion of each handle has an end with an aperture.

4. The exercise apparatus of claim 3, wherein an upper end of each said upper sub-frame has an aperture corresponding with said aperture in said vertical portion of a respective said handle; and a resilient locking device inserted into each corresponding set of apertures to selectively secure each handle to a respective upper sub-frame.

5. The exercise apparatus of claim 3, wherein said ends of each said handle has a reduced diameter for telescopic engagement with respective portions of said upper sub-frame and said bar.

6. The exercise apparatus of claim 1, wherein each said elastic member is a coil spring.

7. The exercise apparatus of claim 1, wherein a foam rubber pad encloses each said elastic member and adjacent portions of said upper and lower sub-frames.

8. The exercise apparatus of claim 1, wherein a bottom end of each said upper sub-frame and a top end of each said lower sub-frame are threaded for engagement with respective elastic members.

9. The exercise apparatus of claim 1, wherein said base further comprises a center opening enclosed by said first plate, said second plate, and said two connecting plates for receiving one of said sockets when said base is folded; and said first plate further comprises a slot for receiving the other of said sockets when said base is folded.

* * * * *